United States Patent [19]

Kamada et al.

[11] 4,297,228

[45] Oct. 27, 1981

[54] DECORATED SOAP AND METHOD FOR PRODUCING THE SAME

[76] Inventors: Masataka Kamada, 94-4071banchi, Haishima-cho, Akishima-city, Tokyo; Seiji Satoh, 6-140banchi, Segasaki, Urawa-city, Saitama-district, both of Japan

[21] Appl. No.: 168,674

[22] Filed: Jul. 14, 1980

[30] Foreign Application Priority Data

Apr. 19, 1980 [JP] Japan ..... 55-51119

[51] Int. Cl.[3] ..... B44C 1/16; C11D 17/00; C11D 17/04

[52] U.S. Cl. ..... 252/92; 40/2 C; 156/237; 156/240; 252/90; 252/93; 252/134; 252/174; 252/DIG. 16; 428/202; 428/203; 428/914

[58] Field of Search ..... 252/92, 93, 90, 134, 252/174, DIG. 16; 156/240, 237; 428/914, 202, 203; 40/2 C

[56] References Cited

U.S. PATENT DOCUMENTS

| | | | |
|---|---|---|---|
| Re. 6,624 | 8/1975 | Strunz | 40/2 C X |
| 3,432,325 | 3/1969 | Baba | 252/93 X |
| 3,565,709 | 2/1971 | Grebe | 252/93 X |
| 3,907,974 | 9/1975 | Smith | 156/240 X |
| 4,111,734 | 9/1978 | Rosenfeld | 156/240 X |

*Primary Examiner*—Dennis L. Albrecht
*Attorney, Agent, or Firm*—Armstrong, Nikaido, Marmelstein & Kubovcik

[57] ABSTRACT

Decorated soap and method for producing the same. The decorated soap comprises a cake of soap, a synthetic resin layer formed on one side surface of said soap, a release layer having a printed layer representing a desired pattern of designs and/or characters and an adhesive layer which joins the synthetic resin layer to the release layer. The above method comprises the steps of: (a) forming a synthetic resin layer on one side surface of soap to be treated, (b) forming a release layer on a backing film, reversely printing a desired pattern to the release layer and forming an adhesive layer on the printed release layer, thereby preparing a transfer sheet, (c) bringing the adhesive layer of transfer sheet into contact with the synthetic resin layer of soap to join the transfer sheet to the synthetic resin layer under heat and pressure, and (d) peeling only the backing film of transfer sheet from the above joined product.

4 Claims, 7 Drawing Figures

DECORATED SOAP AND METHOD FOR PRODUCING THE SAME

BACKGROUND OF THE INVENTION (1) Field of the Invention

This invention relates to decorated soap and the method for producing the same. More particularly, the invention relates to decorated soap and its producing method in which a desired pattern of pictures, designs and characters is transferred onto the surface of soap by using a decalcomania, that is, a pattern transfer sheet.

(2) Description of the Prior Art

In the conventional art, the surface of soap is sometimes applied with a desired pattern such as designs and characters for the purposes of advertisement and decoration. The formation of such a pattern has been done through several methods, for example, an embossing method, known direct printing methods such as gravure printing and offset printing and a method to apply an adhesive sheet that has printed patterns.

When the surface of soap is embossed, a desired pattern can clearly be formed on the surface, however, this method is not suitable for coloring the embossed patterns due to its particular process and the formed pattern is liable to disappear during the use of the soap. Therefore, the purpose of pattern formation cannot fully be attained. In the case of the direct printing method, the printed surface is eroded by the alkalinity of soap and the printing ink runs into the soap body with blurring the printed pattern. This direct printing is not suitable for multi-color printing with the limit of two colors at most. Further, the printed portion is easily dissolved off during the use of soap which is the same as the former case. Still further, when the printing is unsatisfactory, the printed surface layer must be scraped off which increases the production cost.

In the case that an adhesive sheet is applied to the surface of soap, the multi-color printing is possible and the appearance of finished pattern is good. It is, however, impossible to print patterns on a quite thin sheet, so that the sheet that is applied to the surface of soap naturally becomes thick. Accordingly, raised sholder portions are inevitably formed on the surfaces of soaps which cause uncomfortable feeling for the users of the soaps. In addition, the adhesive strength of printed sheet relative to soap is quite low due to the property of the soap itself and the sheet is liable to be peeled off during the use. Furthermore, the above-mentioned disadvantage that the printed pattern falls off and vanishes cannot yet be eliminated. Even when a paraffin protective layer is applied on the surface of the adhesive pattern sheet, the same is caused to occur.

BRIEF SUMMARY OF THE INVENTION

In order to eliminate the foregoing disadvantages in the conventional art, the inventors of the present application have carried out wide and extensive investigations, thereby inventing novel and useful decorated soap and the method for producing the same.

It is, therefore, the primary object of the present invention to provide decorated soap and the method for producing the same, in which a desired pattern of designs and/or characters just like the ordinary printings can be finely and elaborately formed by transferring the pattern onto the surface of soap.

Another object of the present invention is to provide decorated soap and the method for producing the same, in which the pattern of designs and/or characters that is transferred to the surface of soap does neither peel off nor disappear during and after the use of the soap.

A further object of the present invention is to provide decorated soap and the method for producing the same, in which a clear printed layer without blurring is formed on the surface of soap.

Still a further object of the present invention is to provide decorated soap and the method for producing the same, in which the application of multi-color printing of beautiful and complicated pattern to the surface of soap is made possible without the restriction to the two-color printing, which differs from the conventional art.

Still a further object of the present invention is to provide decorated soap and the method for producing the same, in which the printed layer on the surface of soap is quite thin which provides a comfortable feeling in use just like the ordinary soaps, and the printed surface is serviceable as the protective layer for the soap.

Still a further object of the present invention is to provide decorated soap and the method for producing the same, in which the decorated soap can easily be produced without requiring any complicated process and is produced economically at low cost.

Still a further object of the present invention is to provide decorated soap and the method for producing the same, in which the decorated soap can safely be used without any fear of harm and toxicity.

Pursuant to the above-described objects, the present invention proposes the decorated soap which comprises soap, a synthetic resin layer, a release layer having a printed layer representing a pattern that is composed of designs and/or characters and an adhesive layer which joins the synthetic resin layer with the release layer.

BRIEF DESCRIPTION OF THE DRAWINGS

These and other objects, features and advantages of the present invention will become more apparent from the following description taken in connection with the accompanying drawings, in which.

DESCRIPTION OF PREFERRED EMBODIMENTS

Figure 1:
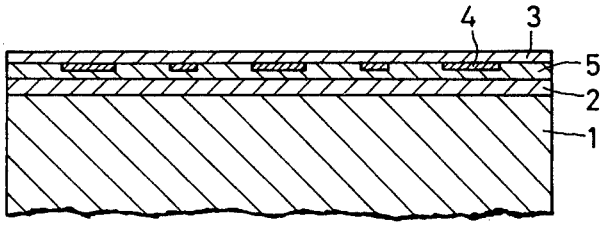
FIG. 1 is an enlarged cross-sectional view of a part of an embodiment of the soap according to the present invention.
Figure 2:
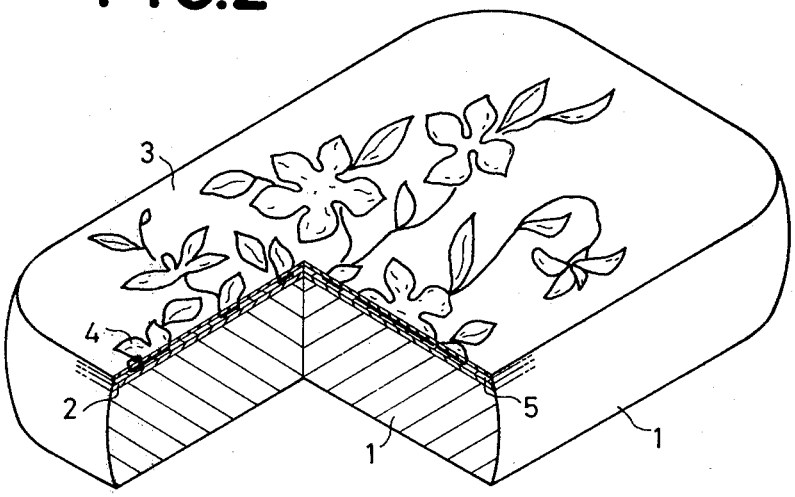
FIG. 2 is a partially cross-sectional perspective view of the same.

The present invention will now be described in more detail with reference to the accompanying drawings.

A cake of soap 1 is provided on its one side surface with a synthetic resin layer 2. The reference numeral 3 indicates a release layer and a printed layer 4 is applied on the rear surface of the release layer 3. The printed layer 4 represents a desired pattern of designs and/or characters and is formed by the ordinary printing method such as gravure printing, offset printing, letterpress printing or silk-screen printing. Interposed between the synthetic resin layer 2 on the soap 1 and the release layer 3 is an adhesive layer 5 which joins the release layer 3 to the synthetic resin layer 2.

With reference to examples, the method for producing the decorated soap of the invention, the compositions of materials for use in the method and the method of formation thereof will be described in the following.

Figure 3:
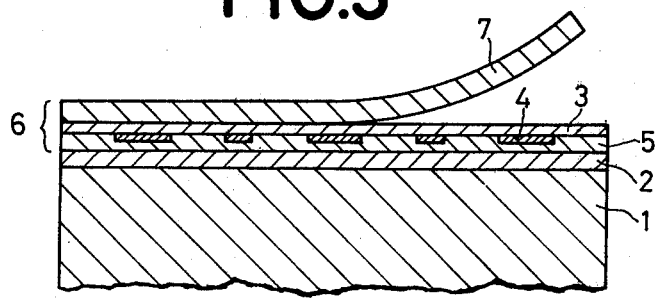
FIG. 3 is an enlarged cross-sectional view illustrating the process of the present invention.

In FIG. 3, the reference numeral 6 denotes a transfer sheet which is composed of a backing film 7, a release layer 3 and an adhesive layer 5. The release layer 3 is applied with a reversely printed layer 4 which represents a desired pattern of designs and/or characters. This release layer 3 is formed on one side surface of the backing film 7. After printing to the release layer 3 on the backing film 7, an adhesive layer 5 is applied on (under side in FIG. 3) the printed surface, thereby forming a transfer sheet 6. Meanwhile, one side surface of the soap 1 is previously applied with a synthetic resin layer 2 and the foregoing transfer sheet 6 is placed over the synthetic resin layer 2 on the soap 1 as shown in FIG. 3. The soap 1 and the transfer sheet 6 are then integrally bonded together. After that, the backing film 7 is peeled off to obtain a decorated soap in which the printed layer 4 is covered by the release layer 3.

Described in the following are the compositions of component parts of the decorated soap of the present invention and the method for forming the same.

(1) Synthetic resin layer 2

The synthetic resin layer 2 is composed of synthetic resins such as acrylic resin, polyvinyl chloride resin, polypropylene and polyethylene. When these thermoplastic resins are applied to the surface of soap 1, for example, a resin solution having the following composition is sprayed over the surface of soap 1.

| Exemplar formula: | |
|---|---|
| Acrylic resin | 30% |
| Nitrocellulose | 15% |
| Solvents (acetone, methyl ethyl ketone, ethyl acetate) | 55% |

Besides the spraying, brushing and roller coating may also be employed likewise for forming the synthetic resin layer 2.

(2) Transfer sheet 6

(a) Backing film 7

As the backing film 7, polyethylene film, polyester terephthalate film, polypropylene film, polystyrene film, regenerated cellulose film, paper and metallized paper are used. Among them, the polyester film is most desirable. When this film is used, the thickness of the film may preferably be in the range of 16 to 30 microns.

(b) Release layer 3

For forming the release layer, cellulose resin solution, silicone resin solution or the like can be used.

| Exemplar formula 1 | | |
|---|---|---|
| (Mainly comprising acetylcellulose) | | |
| Acetylcellulose (Contains 58–62% of acetyl group) | 85.5% | |
| Triphenylphosphate | 10.8% | 23.0% |
| Dimethyl phthalate | 3.7% | |
| Methylene chloride | | 77.0% |

In place of the above methylene chloride, a mixed solution of acetone and ethyl acetate (3:4) can also be used.

| Exemplar formula 2 | | |
|---|---|---|
| (Mainly comprising cellulose propionate) | | |
| Cellulose propionate | 95.5% | 22.5% |
| Dimethyl phthalate | 4.5% | |
| Ethyl acetate | 30% | |
| Acetone | 40% | 77.5% |
| Ethyl lactate | 30% | |
| **Exemplar formula 3** | | |
| (Mainly comprising cellulose acetate butyrate) | | |
| Cellulose acetate butyrate | 13% | |
| Triphenyl phosphate | 2% | |
| Methanol | 61.6% | |
| Toluene | 23.4% | |
| **Exemplar formula 4** | | |
| (Mainly comprising nitrocellulose) | | |
| Nitrocellulose (Nitrogen content: 11.9–12.2%) | | 23% |
| Dibutyl phthalate | | 2% |
| Ethyl acetate | 20% | |
| Denaturated alcohol | 25% | 75% |
| Toluene | 55% | |

One of the above compositions is applied on the backing film 7 by gravure printing method (gravure coating method) to form about one micron thick layer and the solvent is evaporated off to dry, thereby forming a release layer 3. Then, the release layer 3 is subjected to reverse printing to form a transfer sheet 6.

(3) Printing to release layer 3

When a desired pattern of designs and/or characters is printed to the release layer 3, the conventional printing methods such as gravure printing, offset printing, letterpress printing and silk-screen printing can be used.

(4) Adhesive layer 5

As the compositions for forming the adhesive layer 5, the following formular are exemplifed. The suitable thermoplastic resins that are used for this adhesive layer 5 are those having very small compatibility to the release layer 3.

| Exemplar formula 1 | |
|---|---|
| (Mainly comprising synthetic rubber) | |
| Styrene-butadiene polymer | 23% |
| Chlorinated diphenyl | 2% |
| Toluene | 50% |
| Xylene | 25% |
| **Exemplar formula 2** | |
| (Mainly comprising alkyd resin) | |
| 50% xylene solution of Styresol 4250 (Trademark of styrenated alkyd resin) | 50% |
| Toluene | 50% |
| **Exemplar formula 3** | |
| (Mainly comprising polyamide resin) | |
| Bersamide #940 (Trademark of polyamide resin) | 30% |
| Methanol | 35% |
| Toluene | 20% |
| Xylene | 15% |

The adhesive layer 5 is formed by applying any composition of the above formulae to the printed release layer 3 of the transfer sheet 6 by, for example, gravure coating method.

(5) Transferring method to soap 1

Figure 4:
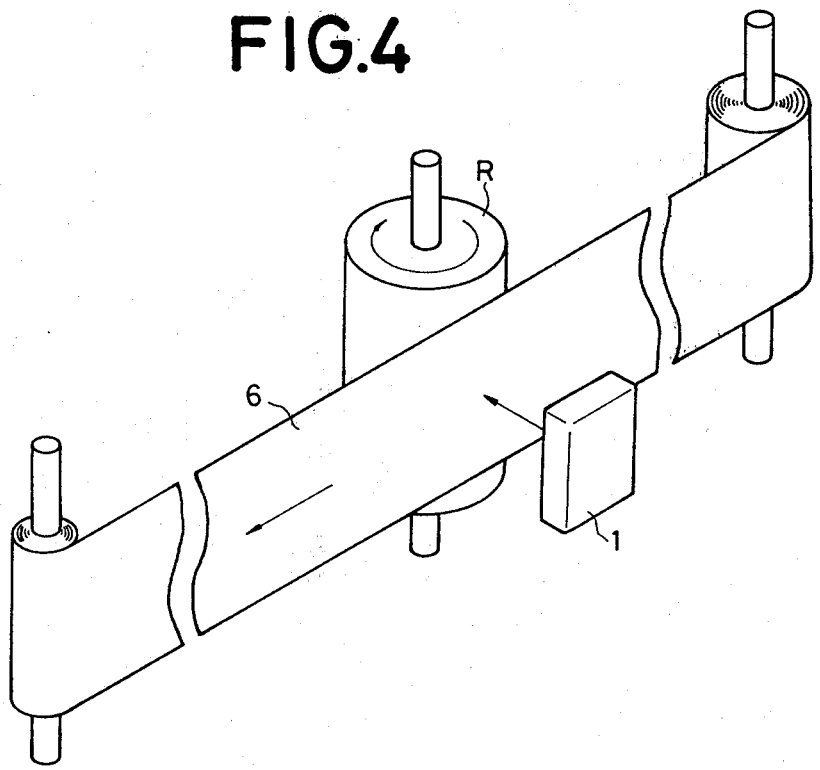
FIG. 4 is a schematic perspective view illustrating the transferring process.

When the printed pattern of the transfer sheet 6 is applied to the surface of soap 1, the surface of adhesive layer 5 of the transfer sheet 6 is momentarily pressed to the surface of synthetic resin layer 2 over the soap 1 by meas of a roller that is heated to 180° C.–250° C., thereby, performing the fusion bonding of the transfer sheet 6 to the synthetic resin layer 2 of soap 1. More particularly, as shown in FIG. 4, the transfer sheet 6 is moved in front of a rotary rubber roller R that is made of, for example, silicone rubber or fluorine-contained rubber and heated to 180° C.–250° C. The synthetic resin layer 2 of a cake of soap 1 is placed opposite to the adhesive layer 5 of transfer sheet 6, and the soap 1 together with the transfer sheet 6 is pressed to the rotary rubber roller R under a pressure of 200 g/cm$^2$–1000 g/cm$^2$. The transfer sheet 6, the soap 1 that is pressed to the transfer sheet 6 and the rotary rubber roller R are synchronously moved in the same direction at a speed of about 5–8 cm/sec. Thus transfer-printed soap 1 is then taken out from a hopper. By repeating the above-described process, the patterns of transfer sheet 6 can be transferred to a plurality cakes of soap 1.

After the thermal pressing of the transfer sheet 6 to the soap 1, the backing film 7 of the transfer sheet 6 can easily be peeled off from the release layer 3 and by peeling the backing film 7, the decorated soap of the present invention is completed.

Figure 7:
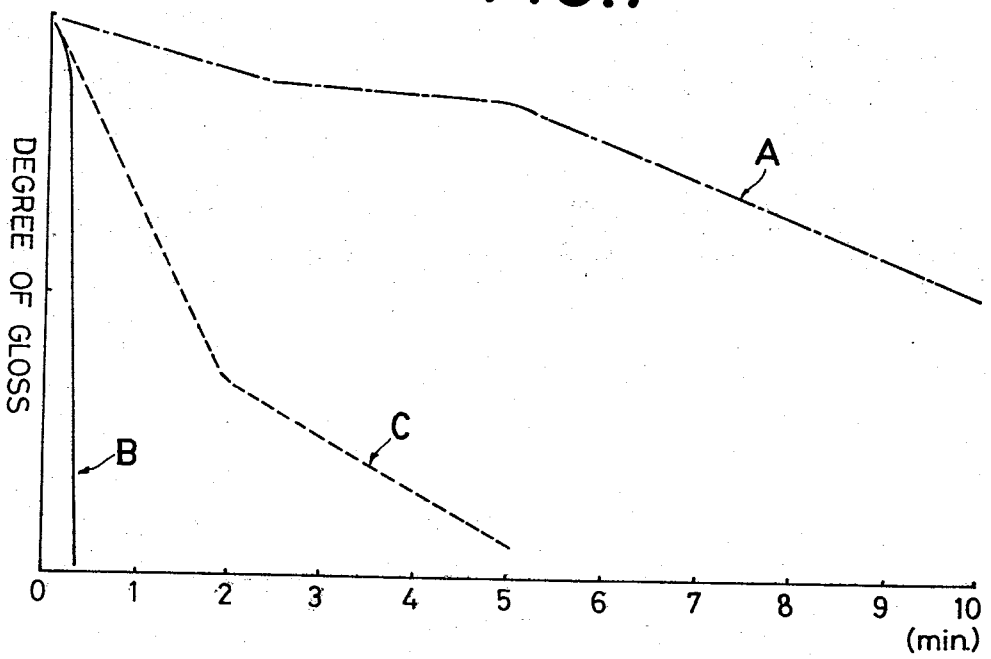
FIG. 7 is a graph showing test results.

The decorated soap that is obtained by the above procedure is compared with the conventional soap in view of degrees of colors and gloss, and peeling property. The test results of this experiment are described below and shown in FIG. 7.

A: Decorated soap of the present invention

Soap was immersed into hot water of 100° C. and taken out after 3 minutes. Even though the surface gloss was slightly lowered, the transferred designs and characters were not peeled off. The result after 5 minutes was almost the same. After 10 minutes, the configuration of soap was somewhat deformed by the hot water, so that the test was stopped. However, any peeling was not observed.

B: Conventional soap (Two colors of red and black were printed to the soap and the printed surface was treated by paraffin)

When the soap was immersed into hot water of 100° C., the printed surface was completely peeled off after 20 seconds.

C: Conventional soap (Printed paper was applied to the surface of soap and the surface was treated with paraffin)

The soap was immersed into hot water of 100° C. with the results that the colored printed surface made a change after 45 seconds and the colors were changed into undersirable condition after 2 minutes. The printed paper was peeled after 5 minutes so that the test was stopped.

Remarks:

The soap is generally used at a temperature below 100° C. However, in order to clarify the effect and advantage of the present invention, the tests were carried out under the severe condition of hot water at 100° C.

Figure 5:
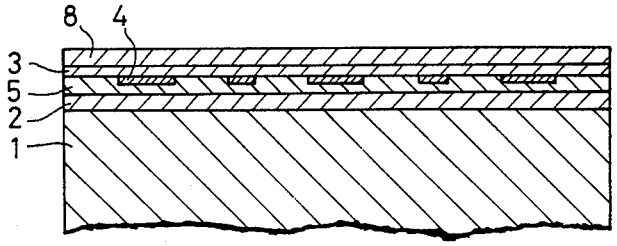
FIG. 5 is an enlarged cross-sectional view of a part of another embodiment of soap.

Shown in FIG. 5 is the soap 1 that is further provided with a synthetic resin layer as a protective layer 8 on the surface of decorated soap 1 of the present invention. The composition and the method for forming this protective layer 8 are the same as the foregoing synthetic resin layer 2 formed on the soap 1. By providing this protective layer 8, the soap 1 becomes sufficiently durable to dirt and shocks.

Figure 6:
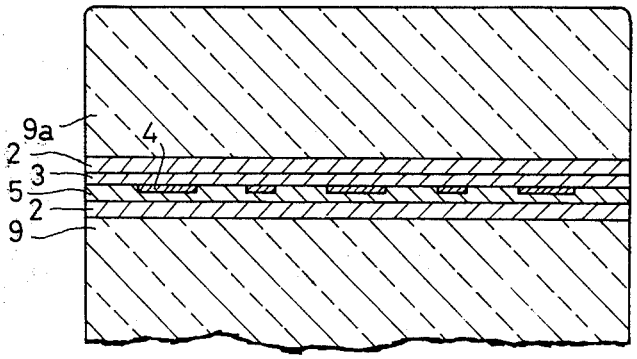
FIG. 6 is also an enlarged cross-sectional view of a part of still another embodiment of soap.

In the embodiment shown in FIG. 6, the pattern of the transfer sheet 6 is formed on a cake of transparent soap 9 and another cake of transparent soap 9*a* is put on the patterned surface of the former transparent soap 9. When the pair of soap cakes are joined, the latter unprinted soap 9*a* is also applied with a synthetic resin layer 2 just like that of the former soap 9 and both cakes of soaps 9 and 9*a* are bonded together by applying a pressure with the treated surfaces inside. With such constitution, the designs and characters are interposed between two cakes of soaps and they can be observed through the soap. Therefore, the designs and characters are not peeled off until the soap is used up. In addition, the decorated soap that is excellent in appearance can be produced which is far different from the conventional art.

Althought the present invention has been described in connection with preferred examples thereof, many variations and modifications will now become apparent to those skilled in the art. It is preferred, therefore, that the present invention be limited not by the specific disclosure herein, but only by the appended claims.

What is claimed is:

1. Decorated soap which comprises, in combination, a cake of soap, a synthetic resin layer formed on one side surface of said soap, said synthetic resin layer being formed by applying a composition of 30% acrylic resin, 15% nitrocellulose and 55% solvents, a release layer having a printed layer representing a pattern consisting of designs and/or characters, said release layer being formed by applying a composition of 15 to 25% cellulose ester plus plasticizer and 75 to 85% solvents, and an adhesive layer which joins said synthetic resin layer with said release layer, said adhesive layer being formed by applying a composition of 23 to 50% adhesive base materials and 50 to 77% solvents.

2. The decorated soap as claimed in claim 1, wherein another layer of synthetic resin is applied on said decorated soap over said release layer, said another synthetic resin layer being formed by applying a composition of 30% acrylic resin, 15% nitrocellulose and 55% solvents.

3. A method for producing decorated soap which comprises the steps of:

a. forming a synthetic resin layer on one side surface of soap to be treated by applying a composition of 30% acrylic resin, 15% nitrocellulose and 55% solvents;

b. forming a release layer on a backing film by applying a composition of 15 to 25% cellulose ester plus plasticizer and 75 to 85% solvents, reversely printing a desired pattern on said release layer, and forming an adhesive layer on said printed release layer by applying a composition of 23 to 50% adhesive base materials and 50 to 77% solvents, thereby forming a transfer sheet;

c. bringing said adhesive layer of transfer sheet into contact with said synthetic resin layer on said soap by moving said transfer sheet in front of a rotary rubber roller which is heated at a temperature between about 180° C. and about 250° C., with said synthetic resin layer on said soap being opposed to said adhesive layer of said transfer sheet, and then pressing said soap together with said transfer sheet to said rotary rubber roller under a pressure between about 200 g/cm$^2$ and 1000 g/cm$^2$; and d. peeling only said backing film of transfer sheet from said joined product.

4. The method for producing decorated soap as in claim 3, wherein, after peeling said backing film in said steps, another synthetic resin layer is formed on the exposed release layer by applying a composition of 30% acrylic resin, 15% nitrocellulose and 55% solvents.

* * * * *